United States Patent [19]

Wold

[11] Patent Number: 4,457,444

[45] Date of Patent: Jul. 3, 1984

[54] COMBINE HOPPER COVER

[75] Inventor: Allan N. Wold, Roseau, Minn.

[73] Assignee: DAT Agri-Products, Inc., Fargo, N. Dak.

[21] Appl. No.: 466,673

[22] Filed: Feb. 15, 1983

[51] Int. Cl.[3] ..... B65D 51/12

[52] U.S. Cl. ..... 220/213; 220/346; 49/40

[58] Field of Search ..... 220/213, 345, 346; 49/40

[56] References Cited

U.S. PATENT DOCUMENTS

| | | | |
|---|---|---|---|
| 242,059 | 5/1981 | Scott | 49/40 |
| 968,828 | 8/1910 | Beckley | 49/40 |
| 1,035,245 | 8/1912 | Sanders . | |
| 1,065,588 | 6/1913 | Carter . | |
| 1,934,929 | 11/1933 | Jonsson | 49/40 |
| 1,935,003 | 11/1933 | White | 220/213 |
| 2,563,845 | 8/1951 | Johnson | 49/40 |
| 2,785,562 | 3/1957 | Tigerman . | |
| 2,864,526 | 12/1958 | Buss | 220/213 |
| 3,485,524 | 12/1969 | Nelson | 296/100 |

*Primary Examiner*—George T. Hall

*Attorney, Agent, or Firm*—Merchant, Gould, Smith, Edell, Welter & Schmidt

[57] ABSTRACT

A combine hopper cover is disclosed. The cover is arched and has raised ribs. A grain inspection door is included and has a flange portion and a recessed portion defining shoulders therebetween. The shoulders form guides for the door to slide along the raised ribs of the arched cover. Stretchable straps hold the cover and the inspection door to the combine hopper.

5 Claims, 2 Drawing Figures

COMBINE HOPPER COVER

FIELD OF THE INVENTION

This invention relates to a cover for the hopper of a combine.

BACKGROUND OF THE INVENTION

Covers for wagons, railroad cars and various other containers are known. Occasionally a tarp or a similar flexible cover is fastened in place. Additionally, however, covers made from wood, fiberglass or some other more rigid material are used. Known covers either completely close the top of a container or include a moveable door or gate portion which is hinged or has a complex track assembly.

With respect to an agricultural combine, it is known that a cover aids in retaining seed or grain while operating in high winds. Also, a cover can protect from weather elements such as rain, snow and other forms of precipitation. Early combine hopper covers were metal, which were heavy and difficult to use. A more recent fiberglass cover is known, but it is a single element and, consequently, when fastened in placed, it is difficult to remove to inspect grain or otherwise check the hopper contents.

Thus, farmers have extremely expensive combining machinery available to them, but have not been able to adequately protect harvested grain during the harvesting process. When known covers are used, they are used with difficulty and often result in the farmer getting frustrated and disgarding the cover.

SUMMARY OF THE INVENTION

The present invention is directed to a cover for a combine hopper wherein the hopper has sidewalls defining an open top. The cover includes a covering member having a flange for mating with the top of the sidewalls of the hopper. The covering member further includes an arcuately shaped sheet between opposite first sides of the flanges. Substantially flat ends extend between the sheet and each second side of the flange. The sheet has a plurality of raised ribs with an opening between a pair of the ribs. The cover further includes a door for covering the opening. The door has a flange with a pair of opposite sides riding on the pair of ribs on either side of the opening. The door also has a recess portion extending between the pair of ribs so as to provide shoulders where the recess portion meets the flange. The shoulders provide guide surfaces for sliding the door along the ribs. The cover also includes a plurality of straps for holding the covering member to the hopper and a strap for holding the door to the covering member.

The combine hopper cover is particularly advantageous since it utilizes a simple, inexpensive covering member attached in a straightforward fashion to the hopper and, yet, has a uniquely simple inspection door. The inspection door is made preferably from fiberglass and, consequently, is easily shaped to include shoulders for contacting spaced apart ribs on the cover member which therefore provide guide surfaces.

The larger covering member provides a protection for grain in the hopper from weather elements. The door in the covering member for covering the opening therein is designed to complete the weather proofing while maintaining the inspection capability. More particularly, the centrally located edge of the opening has an upwardly extending lip while the door has a downwardly extending lip. The two lips make contact both to prevent the door from sliding off the covering member and for providing a weather seal. The lips function in conjunction with the contact which the flange of the door makes with the ribs of the covering member to complete the weather seal.

The use of a single strap extending between a brace in the hopper and the door provides an exceedingly simple hinge mechanism for the door. Hence, the covering member with inspection door remains simple and inexpensive, yet much more functional than the art.

These advantages and other objects attained by this invention are explained further and may be better understood by reference to the drawings and to the more detailed description hereinafter.

DETAILED DESCRIPTION OF THE PREFERRED EMBODIMENT

Figure 1:
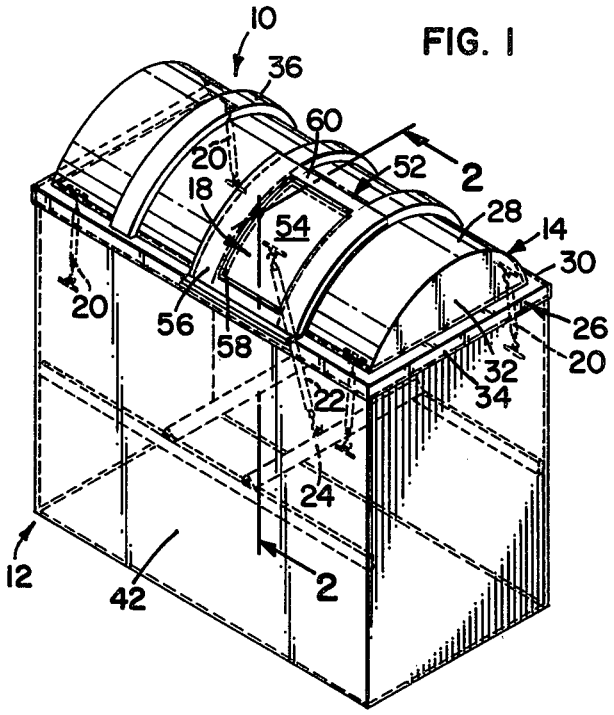
FIG. 1 is a perspective view of a hopper with a cover thereon in accordance with the present invention.

Referring now to the drawings wherein like reference numerals designate identical or corresponding parts throughout the several views, and more particularly to FIG. 1, a cover in accordance with the present invention is designated generally as 10. Cover 10 is shown covering a container 12 which would commonly be a part of an agricultural combine (not shown). Cover 10 is comprised of a covering member 14 having an opening 16 with a door 18. Covering member 14 fits over hopper 12 and is attached thereto with straps 20. Door 18 is held to covering member 14 with a strap 22 extending between door 18 and a brace 24 in hopper 12.

Figure 2:
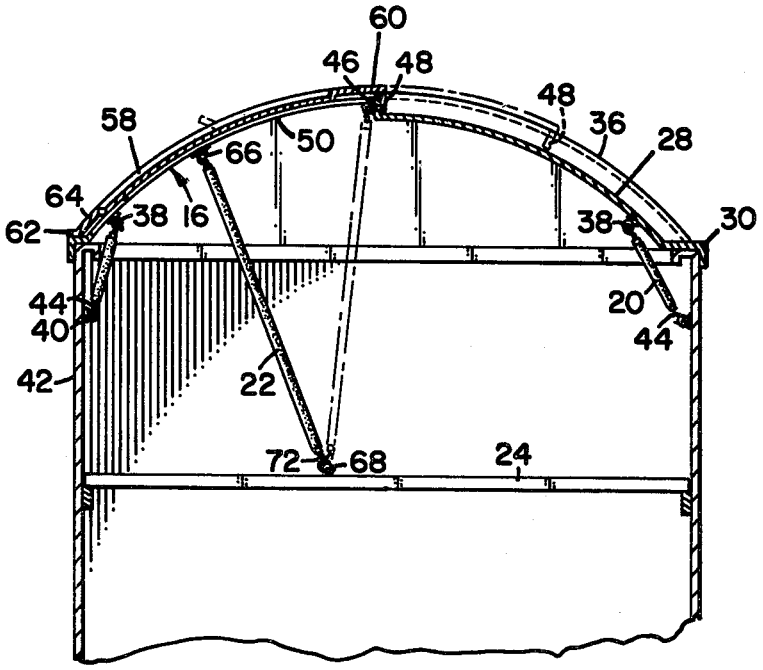
FIG. 2 is a cross-sectional view taken along line 2—2 of FIG. 1.

Covering member 14 is preferably made from fiberglass and, consequently, its shape may include a variety of structural features with all of the features being integral to covering member 14. In particular, covering member 14 is generally rectangular to conform with the open top of hopper 12. The rectangular shape is defined by flange portion 26. As shown in FIG. 2, the cross-sectional shape of flange 26 is that of a right angle member. One leg of the right angle extends downwardly, and the other leg provides a horizontal wall which rests on the top edge of the sidewalls of hopper 12. An arcuate sheet 28 extends between the opposite longer sides 30 of flange 26. Substantially flat ends 32 extend between sheet 28 and shorter sides 34 of flange 26. A number of raised ribs 36 spaced apart from one another are integral with sheet 28. Opening 16 extends between a pair of ribs 36 from near flange 26 of one of longer sides 30 to near the top of sheet 28. Covering member 14, if made from fiberglass, may have substantially the same thickness throughout its various portions, although it is not uncommon to increase the thickness at edges or other locations where greater strength is required. For example, ribs 36 since they are raised from sheet 28 provide added structural strength to sheet 28 although it may be further advantageous to increase the thickness of ribs 36 also.

A plurality of wire rings 38 are fastened, preferably with fiberglass, to the underside of member 14. Rings 38 are spaced apart and are most advantageously located near the corners of covering member 14. Similar rings 40 are fastened with bolts and nuts or some other mechanism to the sidewalls 42 of hopper 12. Straps 20 are preferably stretchable and have hooks 44 at the ends. In this way, covering member 14 may be rapidly attached to hopper 12 by hooking straps 20 appropriately to rings 38 and 40. It is most convenient if straps 20 are relatively short compared to the depth of hopper 12.

Opening 16 is bordered by a pair of ribs 36. At its top edge, a lip 42 is formed to extend upwardly from sheet 28. Lip 46 extends between the pair of ribs 36. Door 18 has a corresponding lip 48 which extends downwardly to contact lip 46 to provide a weather seal and prevent door 18 from sliding off covering member 14. Although not necessary, there is further advantage to extending a short ledge 50 outwardly into opening 16 from each of ribs 36 bordering opening 16. Ledges 50 are approximately at the elevation of the top of lip 46. Ledges 58 aid in deflecting grain in hopper 12 away from the mating surfaces of covering member 14 and door 18.

Door 18 covers opening 16 and has a flange portion 52 about its outer periphery. The central portion 54 of door 18 is recessed. Opposite arcuate sides 56 of flange portion 52 rest on ribs 36 bordering opening 16. The connecting portion between central portion 54 and arcuate side 56 forms a shoulder 58 which guides door 18 when it is slid along ribs 36. As indicated hereinbefore, a lip 48 extends downwardly from upperside 60 of flange portion 52. A horizontal wall 62 extends horizontally outwardly from the lower side 64 of flange portion 52.

A ring 66, similar to rings 38 and 40, is fiberglassed or otherwise attached to the underside of door 18. Preferably, ring 66 is located approximately midway between ribs 36 bordering opening 16 and is located somewhat more toward lower side 64 than upperside 60 of door 18.

A ring 68 is attached to a cross brace 24 in hopper 12 or if no such brace is present, ring 68 may be attached to the bottom of hopper 12. Strap 22 includes hooks 72 at its ends in a fashion similar to hooks 44 of straps 20. Ring 68 is located such that when strap 22 is connected between rings 66 and 68, strap 22 is approximately along a radial line of the arc followed by door 18 as it moves between open and closed positions.

In use, covering member 14 is placed onto a combine hopper 12. Since door 18 is not yet in place, a person may crawl through opening 16 to quickly hook straps 20 between pairs of rings 38 and 40. Also, strap 22 may be hooked to ring 68. The person may then climb out of hopper 12 through opening 16. From the outside of hopper 12, the top end of strap 22 may be hooked to ring 66 on the underside of door 18.

As indicated, it is preferable for covering member 14 and door 18 to be made from fiberglass, a plastic or some other material which may be made transluent or transparent to light. The combine operator may then easily see the general level of grain within the hopper 12. If it is necessary to see more clearly or to inspect the grain, door 18 is easily slid open. Door 18 slids on the pair of ribs 36 bordering opening 16. Door 18 is held in sliding contact with member 14 by stretchable strap 22. If the curvature of sheet 28 is noncircular, strap 22 simply stretches or contracts as door 18 slides. Door 18 is prevented from sliding too far open by strap 22 contacting lip 46. Similarly, door 18 is prevented from closing and sliding off member 14 by lip 48 contacting and stopping against lip 46.

Clearly covering member 14 provides substantial protection against, wind, rain, snow and other weather elements. Since flange 26 fits onto and over the top of sidewalls 42 of hopper 12, weather elements are effectively shielded from the interior of hopper 12. Cover 10, however, is advantageously designed to also prevent the weather elements from entering hopper 12 through opening 16.

Arcuate sides 56 make contact with the ribs 36 bordering opening 16 thereby providing a weather seal on those sides. Lips 46 and 48 make contact and provide a weather seal at the top edge of opening 16. Along the bottom edge, wall 62 contacts the horizontal surface of flange 26 thereby making a weather seal. Strap 22 is sufficiently stretchable to keep door 18 in firm contact with these various surfaces to maintain the integrity of the weather seals.

Thus, cover 10 accomplishes the primary function of preventing weather elements from affecting grain within hopper 12. Additionally, however, cover 10 has an opening 16 which allows for a very simple and inexpensive attachment mechanism to hold cover 10 to hopper 12. Furthermore, door 18 provides an inspection and sampling capability. If cover 10 is made from fiberglass or some other such material, the arch shape and the existence of ribs provides excellent strength without expensive, weight producing additional structural elements. The arch shape also provides for an attractive look and added capacity. With respect to capacity, stretchable straps 20 and 22 allow cover 10 to be forced above hopper 12 in a situation where the hopper is overfilled.

These numerous characteristics and advantages of this invention, together with details of structure and function, have been set forth in the foregoing disclosure. It is to be understood, however, that the disclosure is illustrative only. Thus, changes made, especially in matters of shape, size, and arrangement, to the full extent of the general meaning in the terms in which the claims are expressed, are within the principle of the invention.

What is claimed:

1. A cover for a combine hopper, said hopper having sidewalls defining an open top, said cover comprising:

an integral covering member including flange means for mating with the top of said sidewalls, said member including an arcuately shaped sheet between opposite first sides of said flange means, said member including substantially flat ends extending between said sheet and each second side of said flange means, said sheet having a plurality of raised ribs with an opening between a pair of said ribs;

a door for covering said opening, said door having a flange portion with a pair of opposite sides riding on said pair of ribs, said door having a recessed portion extending between said pair of ribs to provide shoulders where said recessed portion meets said flange portion, said shoulders providing guide surfaces for sliding said door along said ribs;

a plurality of first straps for holding said member to said hopper;

a second strap for holding said door to said covering member;

first means for attaching each of said first straps to said member;

second means for attaching said second strap to said door; and third means for attaching each of said first and second straps to said hopper;

whereby said covering member is held to said hopper and said door is slideably held to said covering member.

2. A cover in accordance with claim 1 wherein said door is made of fiberglass and wherein said second attaching means includes a wire loop fiberglassed to said door, said second strap having a hook attached at an end, said hook for attaching to said loop.

3. A cover in accordance with claim 1 wherein said covering member includes an upwardly extending first lip along a first side of said opening, said first lip being spaced from said flange means and extending between said pair of ribs, said door having a downwardly extending second lip for contacting said first lip and preventing said door from sliding beyond a position which closes said opening, whereby said ribs and said first lip contact said door to provide a weather seal against rain, snow and wind.

4. A cover in accordance with claim 3 wherein said door includes a second side opposite said second lip, said second side having a flat portion parallel to said flange means to rest on said flange means to provide a weather seal.

5. A cover for a combine hopper, said hopper having sidewalls defining an open top, said cover comprising:

an integral translucent fiberglass covering member including flange means for mating with the top of said sidewalls, said member including an arcuately shaped sheet between opposite first sides of said flange means, said member including substantially flat ends each extending between a second side of said flange means and said sheet, said sheet having a plurality of raised, integral ribs with an opening between a pair of said ribs, said covering member including an upwardly extending first lip along a side of said opening spaced from said flange means and extending between said pair of ribs;

a door for covering said opening, said door having a flange portion with a pair of opposite sides riding on said pair of ribs, said door having a recessed portion extending between said pair of ribs to provide shoulders where said recessed portion meets said flange portion, said shoulders providing guide surfaces for sliding said door along said ribs, said door having a downwardly extending second lip for contacting said first lip and preventing said door from sliding beyond a position which closes said opening;

a plurality of stretchable straps for holding said member to said hopper and for holding said door to said covering member, said straps each including a hook at one end thereof;

a plurality of first wire loops fiberglassed to said covering member and a second wire loop fiberglassed to said door, said first and second wire loops held by said hooks of said straps; and means for attaching a second end of each of said straps to said hoppers;

whereby said covering member is held to said hopper and said door is slideably held to said covering member.

* * * * *